US007393249B2

(12) United States Patent
Wagner et al.

(10) Patent No.: US 7,393,249 B2
(45) Date of Patent: Jul. 1, 2008

(54) INTERCONNECTION AND MONITORING MODULE

(75) Inventors: Darin N. Wagner, Chandler, AZ (US); Daniel Eugene DelVecchio, Tempe, AZ (US); William E. Spink, Jr., Goodyear, AZ (US); John Axel Bohlin, Palm Bay, FL (US); Federico Calderon, Palm Bay, FL (US)

(73) Assignee: Trompeter Electronics, Inc., Mesa, AZ (US)

( * ) Notice: Subject to any disclaimer, the term of this patent is extended or adjusted under 35 U.S.C. 154(b) by 0 days.

(21) Appl. No.: 11/790,084

(22) Filed: Apr. 23, 2007

(65) Prior Publication Data

US 2007/0275580 A1 Nov. 29, 2007

Related U.S. Application Data

(60) Provisional application No. 60/793,719, filed on Apr. 21, 2006.

(51) Int. Cl.
*H01R 25/00* (2006.01)

(52) U.S. Cl. ..... 439/638; 439/620.24

(58) Field of Classification Search ..... 439/638, 439/620.01, 620.24, 941
See application file for complete search history.

(56) References Cited

U.S. PATENT DOCUMENTS

| | | | |
|---|---|---|---|
| 3,109,997 | A | 11/1963 | Giger et al. |
| 4,002,399 | A | 1/1977 | Deitch et al. |
| 4,017,770 | A | 4/1977 | Valfre et al. |
| 4,106,841 | A | 8/1978 | Vladic |

(Continued)

FOREIGN PATENT DOCUMENTS

EP 0 330 765 A2 12/1989

(Continued)

OTHER PUBLICATIONS

DSX Digital Signal Cross-Connect, Second Edition, ADC Telecommunications, ADC Telecommunications Inc., 1987, pp. 1-58, 65 and 77-88.

(Continued)

*Primary Examiner*—Tho D. Ta
(74) *Attorney, Agent, or Firm*—Sonnenschein Nath & Rosenthal LLP; Brian R. McGinley

(57) ABSTRACT

An interconnection module provides a normal-through connection for an electrical signal. The interconnection module includes a housing defining an input and an output, a conductor disposed within the housing provides a signal path between the input and the output, and a removable monitor module mated to the housing. The monitor module includes a monitor port and an active circuit for sensing the electrical signal and for providing to the monitor port a monitor signal indicative of the electrical signal. The active circuit is disposed electrically in parallel to the signal path and exhibits an impedance to the signal path that is sufficiently high so that the electrical signal being monitored is not disturbed by the active circuit. The monitor circuit is hot-swappable so that removal or installation of the monitor module from the housing during transmission of the electrical signal through the signal path will not disturb the electrical signal. The interconnection module can be used with digital video signals such as those conforming to the serial data interface (SDI) standard.

20 Claims, 17 Drawing Sheets

U.S. PATENT DOCUMENTS

| | | | | |
|---|---|---|---|---|
| 4,213,013 | A | 7/1980 | Perna et al. | |
| 4,221,445 | A | 9/1980 | Fleischhacker et al. | |
| 4,312,552 | A | 1/1982 | Hughes et al. | |
| 4,423,466 | A | 12/1983 | Beun | |
| 4,509,090 | A | 4/1985 | Kawanami et al. | |
| 4,536,052 | A | 8/1985 | Baker et al. | |
| 4,542,372 | A | 9/1985 | Takach, Jr. | |
| 4,544,984 | A | 10/1985 | Kawanami et al. | |
| 4,595,799 | A | 6/1986 | Krob et al. | |
| 4,633,359 | A | 12/1986 | Mickelson et al. | |
| 4,670,626 | A | 6/1987 | Fisher et al. | |
| 4,682,347 | A | 7/1987 | Lynch | |
| 4,705,921 | A | 11/1987 | Rabey et al. | |
| 4,737,985 | A | 4/1988 | De Luca et al. | |
| 4,749,968 | A | 6/1988 | Burroughs | |
| 4,757,163 | A | 7/1988 | Rabey et al. | |
| 4,768,961 | A | 9/1988 | Lau | |
| 4,770,639 | A | 9/1988 | Lau | |
| 4,772,562 | A | 9/1988 | Lau | |
| 4,773,867 | A | 9/1988 | Keller et al. | |
| 4,784,609 | A | 11/1988 | Lau | |
| 4,797,114 | A | 1/1989 | Lau | |
| 4,807,280 | A | 2/1989 | Posner et al. | |
| 4,811,169 | A | 3/1989 | De Luca et al. | |
| 4,815,104 | A | 3/1989 | Williams et al. | |
| 4,820,200 | A | 4/1989 | Lau | |
| 4,840,568 | A | 6/1989 | Burroughs et al. | |
| 4,861,281 | A | 8/1989 | Warner | |
| 4,874,317 | A | 10/1989 | Lau | |
| 4,975,072 | A | 12/1990 | Afshar | |
| 4,975,087 | A | 12/1990 | Williams et al. | |
| 5,078,624 | A | 1/1992 | Burroughs et al. | |
| 5,127,851 | A | 7/1992 | Hilbert et al. | |
| 5,147,992 | A | 9/1992 | Eriksen et al. | |
| 5,160,273 | A | 11/1992 | Carney | |
| 5,178,558 | A | 1/1993 | Knox et al. | |
| 5,199,878 | A | 4/1993 | Dewey et al. | |
| 5,205,762 | A | 4/1993 | Carney | |
| 5,214,673 | A | 5/1993 | Morgenstern et al. | |
| 5,220,600 | A | 6/1993 | Chouanard et al. | |
| 5,233,501 | A | 8/1993 | Allen et al. | |
| 5,246,378 | A | 9/1993 | Seiceanu | |
| 5,265,156 | A | 11/1993 | Eason et al. | |
| 5,273,448 | A | 12/1993 | Myer et al. | |
| 5,280,254 | A | 1/1994 | Hunter et al. | |
| 5,281,163 | A | 1/1994 | Knox et al. | |
| 5,290,180 | A | 3/1994 | Herrmann | |
| 5,295,846 | A | 3/1994 | Sumida et al. | |
| 5,343,194 | A | 8/1994 | Bowdon | |
| 5,348,491 | A | 9/1994 | Louwagie et al. | |
| 5,352,128 | A | 10/1994 | Bricaud | |
| 5,371,786 | A | 12/1994 | Paul | |
| 5,382,173 | A | 1/1995 | Brown et al. | |
| 5,393,249 | A | 2/1995 | Morgenstern et al. | |
| 5,413,494 | A | 5/1995 | Dewey et al. | |
| 5,430,615 | A | 7/1995 | Keeth et al. | |
| 5,432,847 | A | 7/1995 | Hill et al. | |
| 5,438,617 | A | 8/1995 | Hill et al. | |
| 5,439,395 | A | 8/1995 | Laukzemis | |
| 5,454,725 | A | 10/1995 | Speiser et al. | |
| 5,456,608 | A | 10/1995 | Rogers et al. | |
| 5,467,062 | A | 11/1995 | Burroughs | |
| 5,482,469 | A | 1/1996 | Seiceanu et al. | |
| 5,505,631 | A | 4/1996 | Schauer et al. | |
| 5,518,414 | A | 5/1996 | Antonini et al. | |
| 5,530,954 | A | 6/1996 | Larson et al. | |
| 5,546,282 | A | 8/1996 | Hill et al. | |
| 5,552,962 | A | 9/1996 | Feustel et al. | |
| 5,566,056 | A | 10/1996 | Chaudhry | |
| 5,577,924 | A | 11/1996 | Louwagie | |
| 5,582,525 | A | 12/1996 | Louwagie et al. | |
| 5,589,719 | A * | 12/1996 | Fiset | 307/131 |
| 5,594,347 | A | 1/1997 | Louwagie et al. | |
| 5,631,902 | A | 5/1997 | Yoshifuji | |
| 5,634,822 | A | 6/1997 | Gunell | |
| 5,639,261 | A | 6/1997 | Rutkowski et al. | |
| 5,657,196 | A | 8/1997 | Chaudhry et al. | |
| 5,685,741 | A | 11/1997 | Dewey et al. | |
| 5,702,262 | A | 12/1997 | Brown et al. | |
| 5,724,220 | A | 3/1998 | Chaudhry | |
| 5,797,759 | A | 8/1998 | Mattis et al. | |
| 5,879,197 | A | 3/1999 | Dewey | |
| 5,885,096 | A | 3/1999 | Ogren | |
| 5,897,383 | A | 4/1999 | Johnston | |
| 5,903,829 | A | 5/1999 | Anderson et al. | |
| 5,909,155 | A | 6/1999 | Anderson et al. | |
| 5,913,701 | A | 6/1999 | Olson et al. | |
| 5,938,478 | A | 8/1999 | Werner | |
| 5,964,607 | A | 10/1999 | Finke et al. | |
| 5,980,321 | A | 11/1999 | Cohen et al. | |
| 5,983,294 | A | 11/1999 | Kim et al. | |
| 5,993,259 | A | 11/1999 | Stokoe et al. | |
| 5,997,311 | A | 12/1999 | Crouse et al. | |
| 6,018,452 | A | 1/2000 | Meyerhoefer et al. | |
| 6,045,378 | A | 4/2000 | Follingstad | |
| 6,077,113 | A | 6/2000 | Lecomte | |
| 6,116,961 | A | 9/2000 | Henneberger et al. | |
| 6,146,167 | A | 11/2000 | Kutsch | |
| 6,198,720 | B1 | 3/2001 | Deschaine et al. | |
| 6,213,801 | B1 | 4/2001 | Tayloe et al. | |
| 6,227,889 | B1 | 5/2001 | Wu | |
| 6,241,562 | B1 | 6/2001 | Benda et al. | |
| 6,250,936 | B1 * | 6/2001 | Armistead et al. | 439/98 |
| 6,269,162 | B1 | 7/2001 | McMillan | |
| RE37,368 | E | 9/2001 | Huppenthal et al. | |
| 6,299,483 | B1 | 10/2001 | Cohen et al. | |
| 6,328,608 | B1 | 12/2001 | Olson et al. | |
| 6,345,986 | B1 | 2/2002 | Follingstad et al. | |
| 6,352,451 | B1 | 3/2002 | Henneberger et al. | |
| 6,422,902 | B1 | 7/2002 | Ogren et al. | |
| 6,453,014 | B1 | 9/2002 | Jacobson et al. | |
| 6,457,999 | B1 | 10/2002 | Baker et al. | |
| 6,493,319 | B1 | 12/2002 | Kramarczyk et al. | |
| 6,503,105 | B1 | 1/2003 | Johnsen | |
| 6,533,616 | B2 | 3/2003 | Johnsen et al. | |
| 6,572,413 | B2 | 6/2003 | Olson et al. | |
| 6,575,792 | B2 | 6/2003 | Henneberger et al. | |
| 6,587,354 | B1 | 7/2003 | Kutsch et al. | |
| 6,589,062 | B1 | 7/2003 | Ogren et al. | |
| 6,676,443 | B1 | 1/2004 | Wang | |
| 6,743,032 | B2 | 6/2004 | Ogren et al. | |
| 6,752,665 | B2 * | 6/2004 | Kha et al. | 439/668 |
| 6,761,594 | B2 | 7/2004 | Johnsen et al. | |
| 6,817,876 | B2 | 11/2004 | Cooper et al. | |
| 6,830,486 | B2 | 12/2004 | Norris et al. | |
| 6,830,487 | B2 | 12/2004 | Kluempke | |
| 6,848,948 | B1 | 2/2005 | Khemakhem et al. | |
| 6,872,097 | B2 | 3/2005 | Johnsen et al. | |
| 7,038,918 | B2 * | 5/2006 | AbuGhazaleh et al. | 361/780 |
| 7,121,896 | B2 | 10/2006 | Norris et al. | |
| 7,238,035 | B2 | 7/2007 | Silver | |
| 2002/0081907 | A1 | 6/2002 | Olson et al. | |
| 2002/0151222 | A1 | 10/2002 | Baker et al. | |
| 2002/0182938 | A1 | 12/2002 | Fuller | |
| 2002/0182939 | A1 | 12/2002 | Jayne et al. | |
| 2002/0190700 | A1 | 12/2002 | Tzotzkov | |
| 2003/0013346 | A1 | 1/2003 | Perrone et al. | |
| 2003/0022543 | A1 | 1/2003 | Ogren et al. | |
| 2003/0022559 | A1 | 1/2003 | Musolf et al. | |
| 2003/0134541 | A1 | 7/2003 | Johnsen et al. | |
| 2003/0157841 | A1 * | 8/2003 | Jun et al. | 439/638 |
| 2003/0228781 | A1 | 12/2003 | Cooper et al. | |
| 2004/0014365 | A1 | 1/2004 | Norris et al. | |
| 2004/0014366 | A1 | 1/2004 | Kluempke | |

| | | | |
|---|---|---|---|
| 2004/0253860 | A1 | 12/2004 | Loeffelholz et al. |
| 2005/0026506 | A1 | 2/2005 | Kha et al. |

FOREIGN PATENT DOCUMENTS

| | | | |
|---|---|---|---|
| EP | 0 412 045 | A2 | 2/1991 |
| EP | 0 987 905 | A2 | 3/2000 |
| GB | 2 111 770 | A | 7/1983 |
| WO | WO 96/38884 | A1 | 12/1996 |
| WO | WO 98/38703 | | 9/1998 |

OTHER PUBLICATIONS

"tini-telephone" and Standard Patching Systems & Components, Switchcraft.RTM., Switchcraft, Inc., 1985, pp. 43.80, 87-88.
Trompeter Electronics Inc., Coax .cndot.Twinax .cndot.Triax Patching .cndot.Cable Assemblies .cndot.Connectors, Product Catalog, 1986, pp. 1-2 and 16, Thousand Oaks, CA.
Trompeter Electronics, Inc., "Outside Plant DS3 Deployment Connectivity Hardware", pp. 1-12, last retrieved on Nov. 9, 2006, http://www.trompeter.com/asset/catalogs/OutsidePlant.pdf.
TII Network Technologies, Inc., "TII 98: Coax Service Module (CSM)", Coax Protectors, Mar. 2002, 2 pages.
TII Network Technologies, Inc., "TII 126 SO2: Solid State Protector Module", Surge Arresters, Mar. 2002, 2 pages.
TII Network Technologies, Inc., "TII 126: Heavy Duty Totel Failsafe TDS Station Protector", Surge Arresters, Mar. 2002, 2 pages.
TII Network Technologies, Inc., "TII 127M: Heavy Duty Station Protector", Surge Arresters, Mar. 2002, 2 pages.
TII Network Technologies, Inc., "TII 355: Maximum Duty Totel Failsafe TFS Station Protector Module", Surge Arresters, Mar. 2002, 2 pages.
TII Network Technologies, Inc., "TII 356: Heavy Duty Totel Failsafe TFS Station Protector Module", Surge Arresters, Mar. 2002, 2 pages.
TII Network Technologies, Inc., "TII 356M2: Heavy Duty Station Protector", Surge Arresters, Mar. 2002, 2 pages.
TII Network Technologies, Inc., "TII 356M3: Heavy Duty Totel Failsafe TFS Station Protector Module with Over-Current Protection", Surge Arresters, Mar. 2002, 2 pages.
TII Network Technologies, Inc., "TII 358C: Heavy Duty Totel Failsafe TFS Station Protector Module", Surge Arresters, Mar. 2002, 2 pages.
TII Network Technologies, Inc., "TII 372-S/372-S1: 10 Base-T Surge Protection Module", Surge Arresters, Mar. 2002, 2 pages.
TII Network Technologies, Inc., "TII 385: Maximum Duty Totel Failsafe TFS Hybrd Station Protector Module", Surge Arresters, Mar. 2002, 2 pages.
TII Network Technologies, Inc., "TII Angle Driver AD-01W: Gel-Sealed Station Protector", Surge Arresters, Mar. 2002, 2 pages.
TII Network Technologies, Inc., "TII Angle Driver AD-01W-FS: DSL-Compliant Sealed Station Protector", Surge Arresters, Mar. 2002, 2 pages.
TII Network Technologies, Inc., "TII Angle Driver AD-02W-FS: DSL-Compliant Sealed Station Protector", Surge Arresters, Mar. 2002, 2 pages.
TII Network Technologies, Inc., "TII Angle Driver AD-03W-FS: High Voltage "Line to Line" DSL-Compliant Sealed Station Protector", Surge Arresters, Mar. 2002, 2 pages.
TII Network Technologies, Inc., "TII Angle Driver AD-M2-W-FS: DSL-Compliant Sealed Station Protector", Surge Arresters, Mar. 2002, 2 pages.

* cited by examiner

INTERCONNECTION AND MONITORING MODULE

CROSS REFERENCE TO RELATED APPLICATIONS

This patent application claims priority under 35 U.S.C. §119(e) to U.S. Provisional Application No. 60/793,719, filed Apr. 21, 2006, which is incorporated herein by reference as if reproduced in full below.

BACKGROUND OF THE INVENTION

1. Field of the Invention

The present invention is related to an interconnection module that permits monitoring of signals passing therethrough and, more particularly, to an interconnection module for providing a normal-through connection between two coaxial transmission lines carrying, for example, digital video signals that conform to the serial data interface (SDI) standard.

2. Background Art

In the telecommunications and broadcast industries (including, for example, telephone, television broadcast, high-definition television and video, and serial data interface (SDI)), an interconnection module is used to connect two signal lines and to facilitate monitoring of the signals. For example, a typical module includes a housing having a front face and a rear face. A pair of ports on the rear face is configured to receive the signal lines to be connected. A port on the front face is used to monitor the signal passing through the module. The rear ports are typically configured as BNC jacks, while the front port may be a BNC jack or a WECo (Western Electric Company) or mini WECo jack.

To monitor a signal passing through the module, a plug is placed into the monitor port of the module. It is important that the monitoring not disturb, interrupt or otherwise interfere with the signal passing through the module. In the case of high frequency digital signals such as SDI signals passing through 75 Ohm impedance cable, one known approach to prevent the monitoring from interfering with signals is to provide an in-line amplifier within the module. Failure of the in-line amplifier, however, can disrupt signal transmission.

BRIEF DESCRIPTION OF THE DRAWINGS/FIGURES

The features and advantages of the present invention will become apparent from the detailed description set forth below, when taken in conjunction with the drawings in which like reference numbers indicate identical or functionally similar elements. Additionally, the left-most digit of a reference number identifies the drawing in which the reference number first appears.

DETAILED DESCRIPTION OF THE INVENTION

Figure 1:
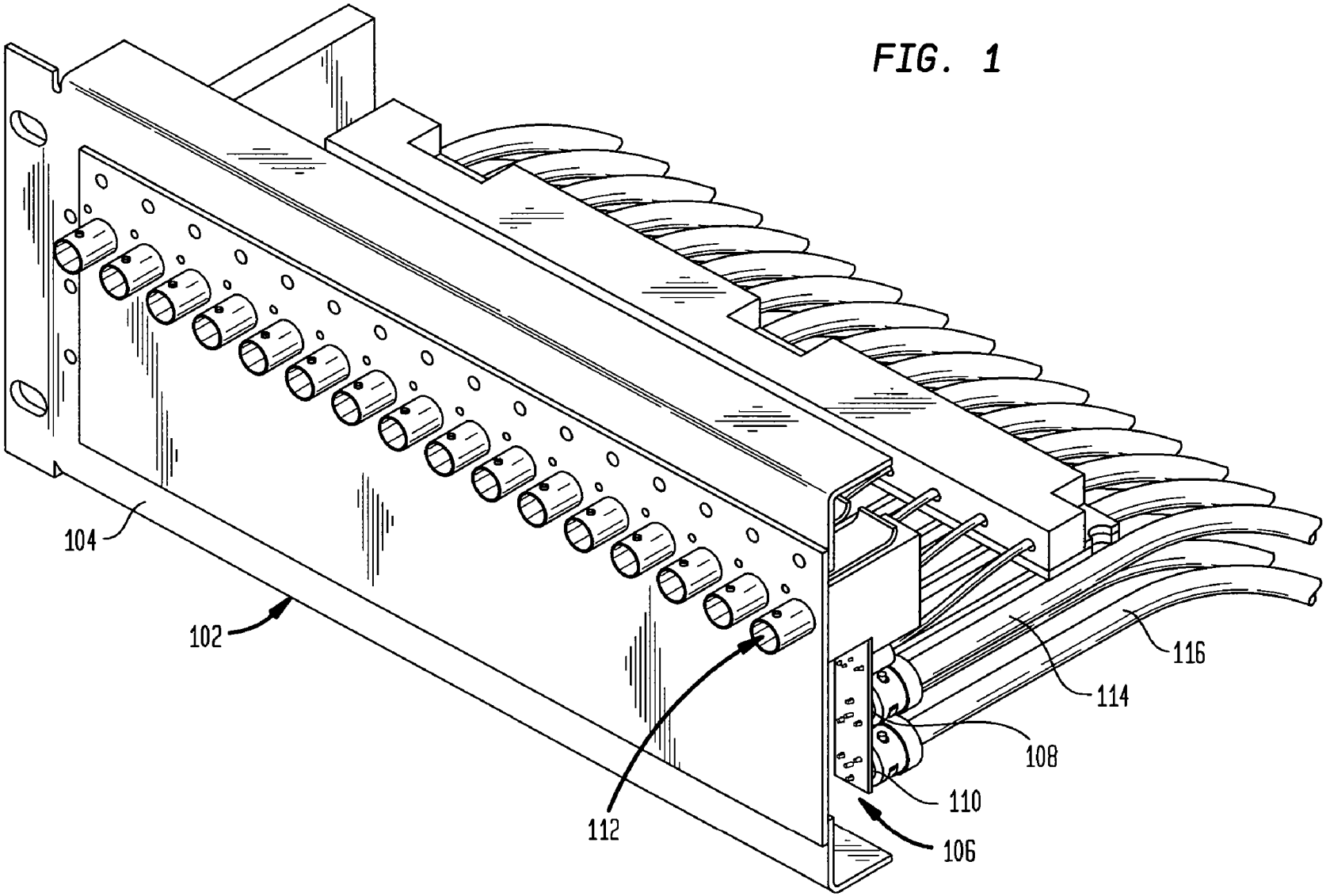
FIG. 1 is a perspective view (as seen from the front and left side from the perspective of the module) of a plurality of interconnection modules in a chassis for rack mounting.

According to an exemplary embodiment, the present invention includes an interconnection module for providing a normal-through connection for a first signal (also called an "electrical signal" or simply a "signal"). The module comprises a housing defining an input and an output, a conductor disposed with the housing to provide to the first signal a signal path between the input and the output, and a monitor module mated to the housing. The monitor module includes a monitor port and an active circuit (e.g., an operational amplifier circuit) for sensing the first signal and for providing to the monitor port a monitor signal indicative of the first signal. The active circuit is disposed electrically in parallel to the signal path and exhibits an impedance to the signal path that is sufficiently high so that the first signal is not disturbed by the active circuit.

The monitor module is removable from the housing. Removal or installation of the monitor module from the housing during transmission of the first signal through the signal path will not disturb the first signal, making the monitor module hot-swappable. Further, failure of the active circuit also will not disturb, interrupt or otherwise interfere with the first signal.

Either the monitor module or the housing comprises a first electrical connector having a chamfered female opening. The other one of the monitor module and the housing comprises a second electrical connector for interfacing with the first electrical connector, the second electrical connector has a male extension configured to mate with the chamfered female opening. The chamfered female opening provides blind mate-ability between the first and second electrical connectors. The male extension may also be chamfered to further improve blind mate-ability.

In one embodiment, the housing includes a front face and a rear face. The input includes an input connector at the rear face for receiving the first signal. The output includes an output connector at the rear face for transmitting the first signal received at the input connector. The conductor provides a signal path between the input connector and the output connector. The monitor module is removably mounted to the housing such that the monitor port is disposed at the front face. The monitor port, the input connector and the output connector are, for example, BNC connectors or mini BNC connectors. Also in this example, the first connector, the second connector and the conductor exhibit an impedance of 75 Ohms.

In this example embodiment, the active circuit comprises an operational amplifier circuit. A resister having a value of, for example, not less than about 1000 Ohms is placed in series between the conductor and an input of the operational amplifier circuit to ensure that, even upon failure of the operational amplifier circuit, the monitor circuit will not interfere with the first signal. For example, even given a failure mode in which the input of the operational amplifier is shorted to ground, the first signal would still see a worst-case impedance through the series resistor of, for example, about 1000 Ohms.

In one exemplary embodiment, the module is a digital video module configured for use with low power digital communications such as digital video signals conforming to the serial data interface (SDI) standard. The SDI standard is standardized in ITU-R BT.656 and SMPTE-259M of the Society of Motion Picture Television Engineers (SMPTE). See, for example, http://www.smpte.org. The SDI signal is, for example, a 270 bps (bit per second) signal operating at 135 MHz. The SDI signal is received from an input coaxial cable which is interfaced to the module via a BNC or mini-BNC connector. The SDI signal is typically transmitted on an output coaxial cable which is interfaced to the module via a BNC or mini-BNC connector. The cables are typically 75 Ohm transmission lines. Thus, the connectors and the module are also configured to exhibit about 75 Ohms impedance at the frequency of interest to ensure minimal signal attenuation.

It is an advantage of the invention that a signal passing through the interconnection module may be monitored without requiring mechanical patching. It is another advantage of the invention that the monitoring functionality of the interconnection module will not disturb the signal passing through the module. It is still another advantage of the invention that failure of the monitor module will not disturb the signal passing through the module. It is yet another advantage of the invention that the monitor module may be "hot swapped" while signals are passing through the interconnection module without disturbing those signals. Another advantage of the invention is that blind mating between the monitor module and the housing of the interconnection module is provided so that the monitoring module may be readily removed from and installed in the housing.

It is another advantage of the present invention that the interconnection module of the invention may be easily manufactured.

The present invention is now described in more detail herein in terms of an exemplary embodiment system for use with digital video signals according to the SDI standard. This is for convenience only and is not intended to limit the application of the present invention. In fact, after reading the following description, it will be apparent to one skilled in the relevant art(s) how to implement the following invention in alternative embodiments.

As shown in FIG. 1, a plurality of interconnection modules 106 are mounted side-by-side in a chassis 102. Chassis 102 is configured to receive a plurality (e.g., 32) of interconnection modules 106 and is configured to be mounted in a rack with a plurality of similar chassis 102. As shown, each module 106 includes an input jack 108, an output jack 110 and a monitor jack 112. Input jack 108 is configured to receive an input cable 114. Each output jack 110 is configured to receive an output cable 116. Each monitor jack 112 is configured to receive a monitor cable (not shown in FIG. 1). A power cable 118 provides power to each module 106.

Figure 2:
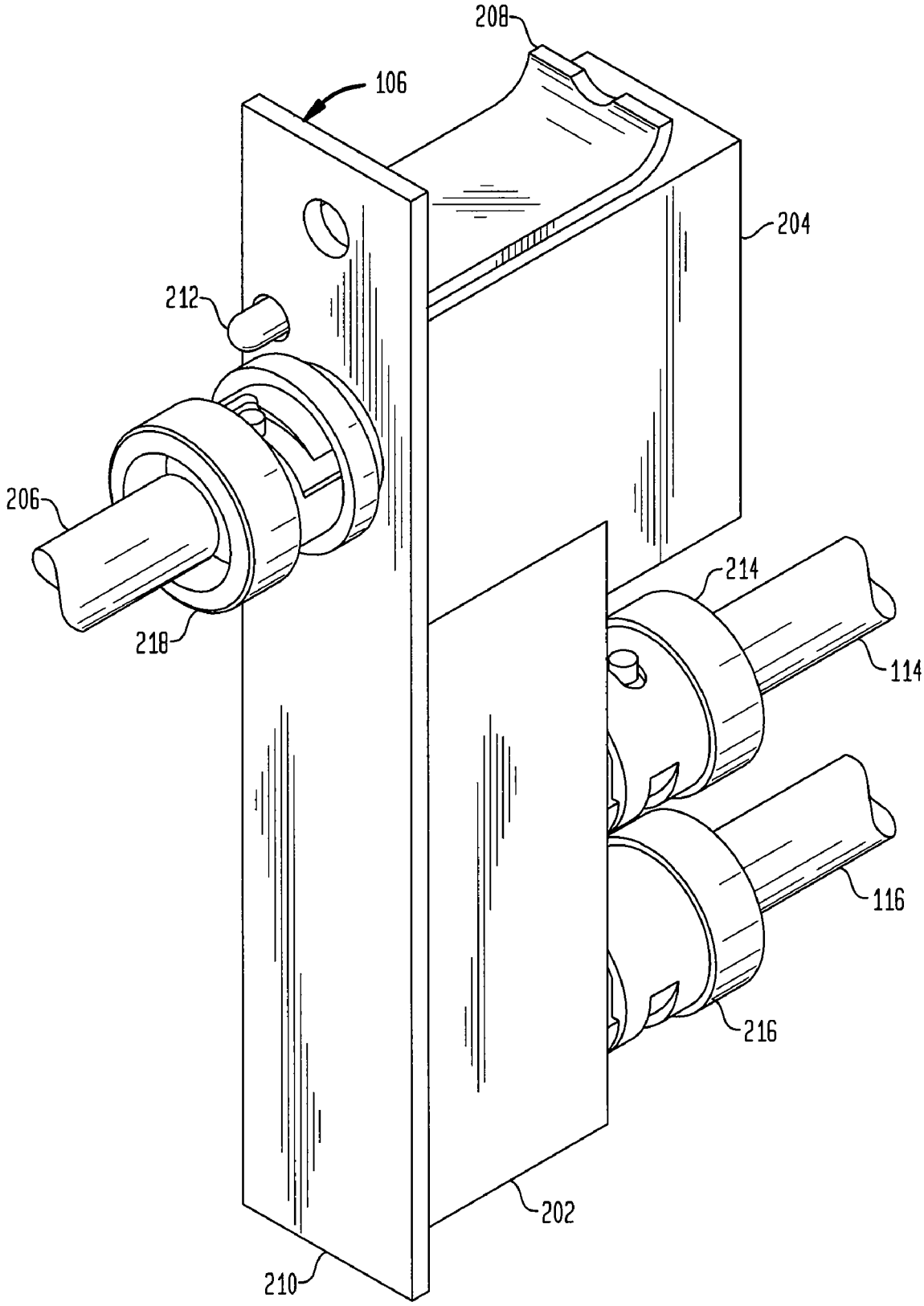
FIG. 2 is a perspective view (as seen from the front and left side from the perspective of the module) of an interconnection module connected to input, output and monitoring cables.

A single module 106 is shown in FIG. 2. As shown, module 106 includes a housing 202 having a front face 210 and a latch 208. A removable monitor module 204 is coupled to housing 202. Latch 208 holds monitor module 204 in position in housing 202. Input cable 114 is coupled to input jack 108 via a plug 214. Output cable 116 is coupled to jack 110 via a plug 216. A monitor cable 206 is coupled to monitor jack 112 via plug 218. In one embodiment jacks 108, 110 and 112 and plugs 214, 216 and 218 are BNC connectors or mini BNC connectors.

A light emitting diode (LED) 212 of monitor module 204 is shown at front face 210 of housing 202. LED 212 is described in further detail below.

Figure 3:
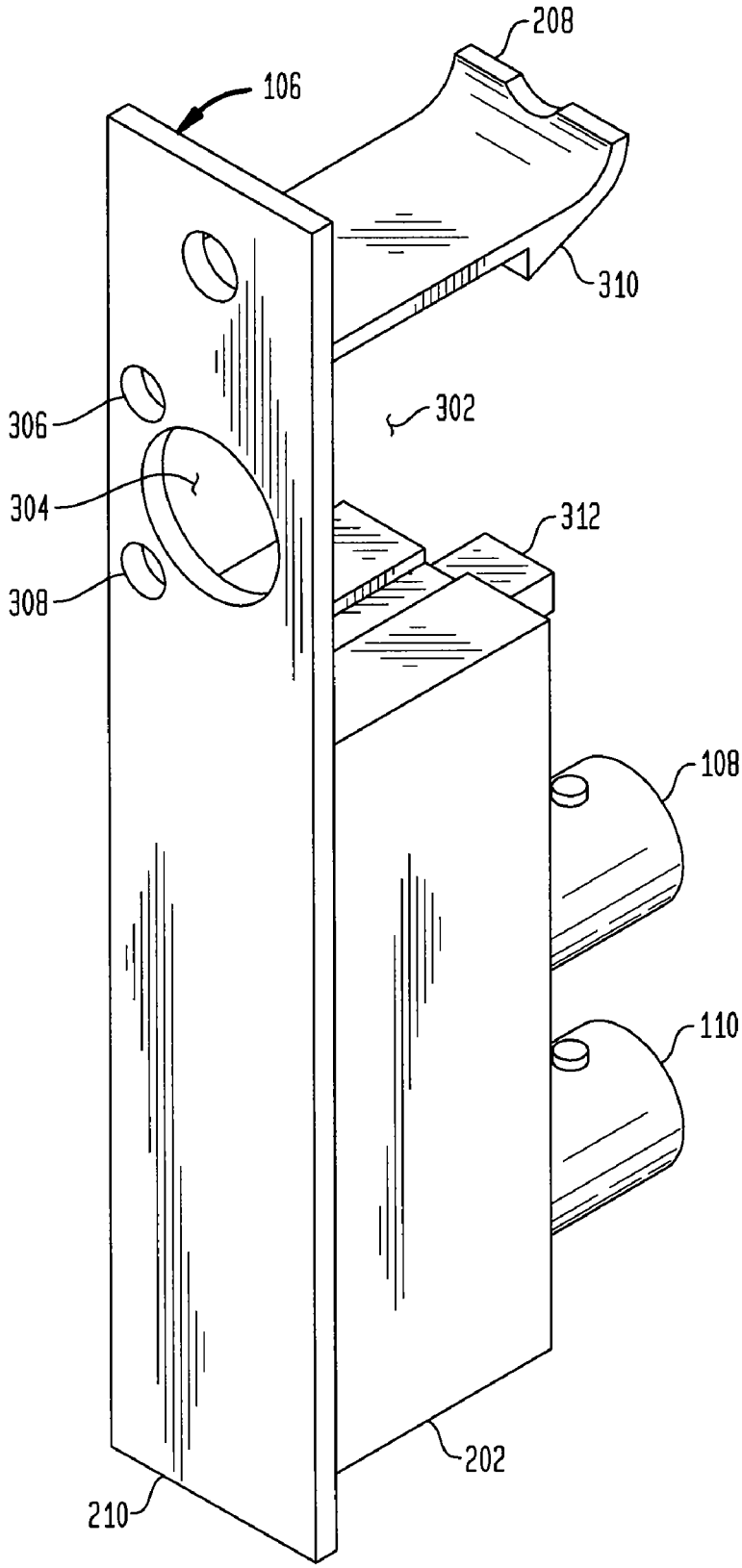
FIG. 3 is a perspective view (as seen from the front and left side from the perspective of the module) of an interconnection module with the monitoring module removed.

FIG. 3 shows module 106 with monitor module 204 removed. With monitor module 204 removed, FIG. 3 shows a recess 302 configured to receive monitor module 204. An opening 304 in front face 210 allows monitor jack 112 of monitor module 204 to pass therethrough. Openings 306 and 308 are configured to allows passage of LEDs of monitor module 204 to pass therethrough. A protrusion or extension 310 of latch 208 is configured to mate with a recess (described below) of monitor module 204 to retain monitor module 204 in recess 302 of housing 202. A connector 312 provides electrical connection between electrical circuitry within housing 202, and electrical circuitry within monitor module 204.

Figure 4:
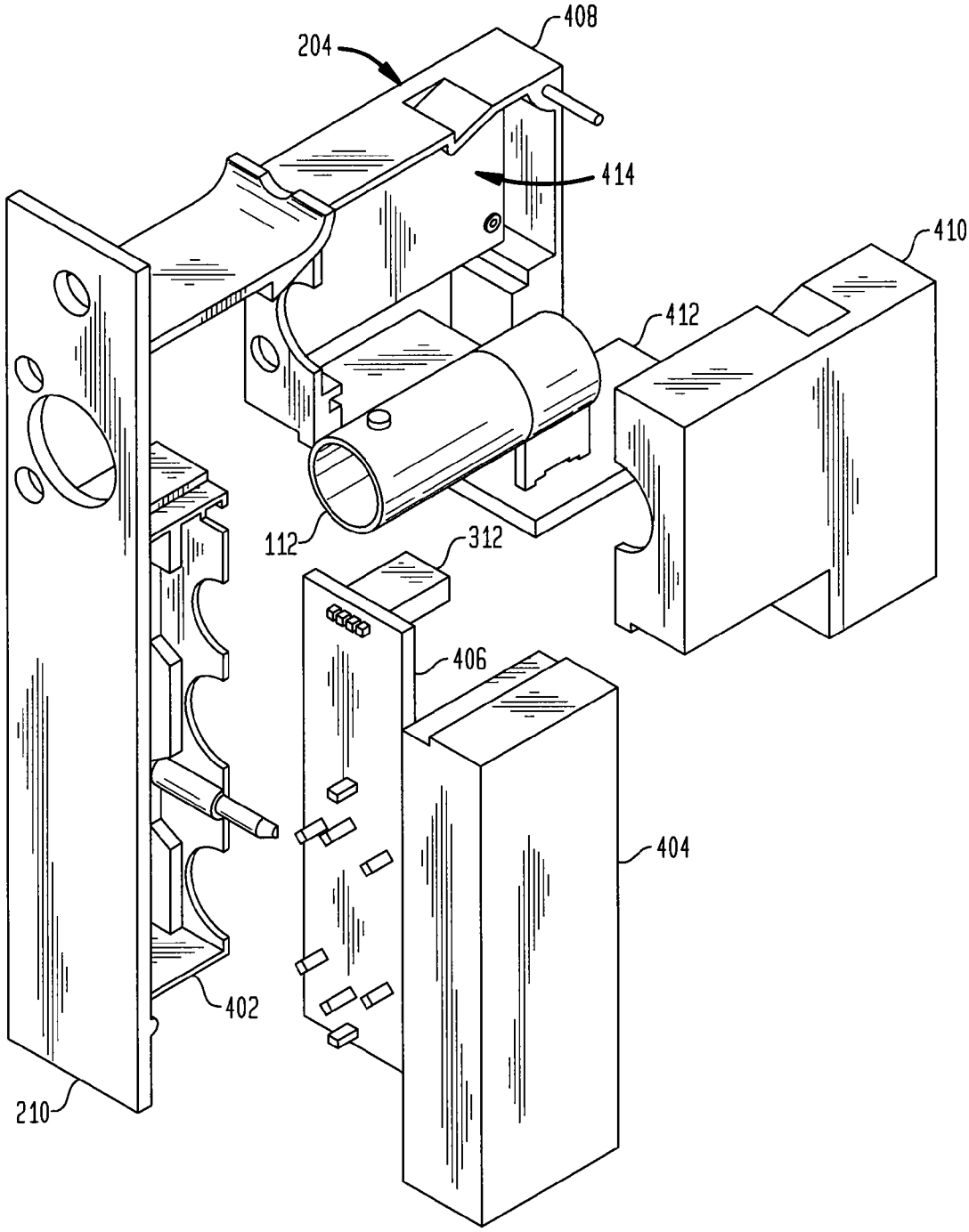
FIG. 4 is a perspective, exploded view (as seen from the front and left side from the perspective of the module) of an interconnection module.

As shown in FIG. 4, housing 202 includes housing half 402 and housing half 404. A normal-through printed circuit board (PCB) 406 is disposed within housing 202 formed by housing halves 402, 404. Electrical connector 312 is mounted on PCB 406. Jacks 108, 110 are also mounted to PCB 406. In FIG. 4, only the portions of jacks 108, 110 protruding through a back-side of PCB 406 are shown. A copper trace (not shown) on PCB 406 provides the normal-through connection between jacks 108 and 110. PCB 406 also provides a conductive trace (not shown) that is routed from PCB 406 to monitor module 204 via connector 312 to enable the monitoring function of module 106.

Also as shown in FIG. 4, monitor module 204 includes a housing half 408 and a housing half 410. A monitor PCB 412 and a "watch dog" PCB 414 are enclosed between housing halves 408, 410. Monitor jack 112 is mounted to monitor PCB 412.

Housing halves 402, 404, 408 and 410 may be formed of various materials. For example, in one embodiment, these housing halves may be formed of a plastic material, and may be attached together using a snap fit. The plastic material may be conductive, or non-conductive. In another example embodiment, the housing halves may be formed either by casting or machining from a metallic material, such as steel.

Figure 5:
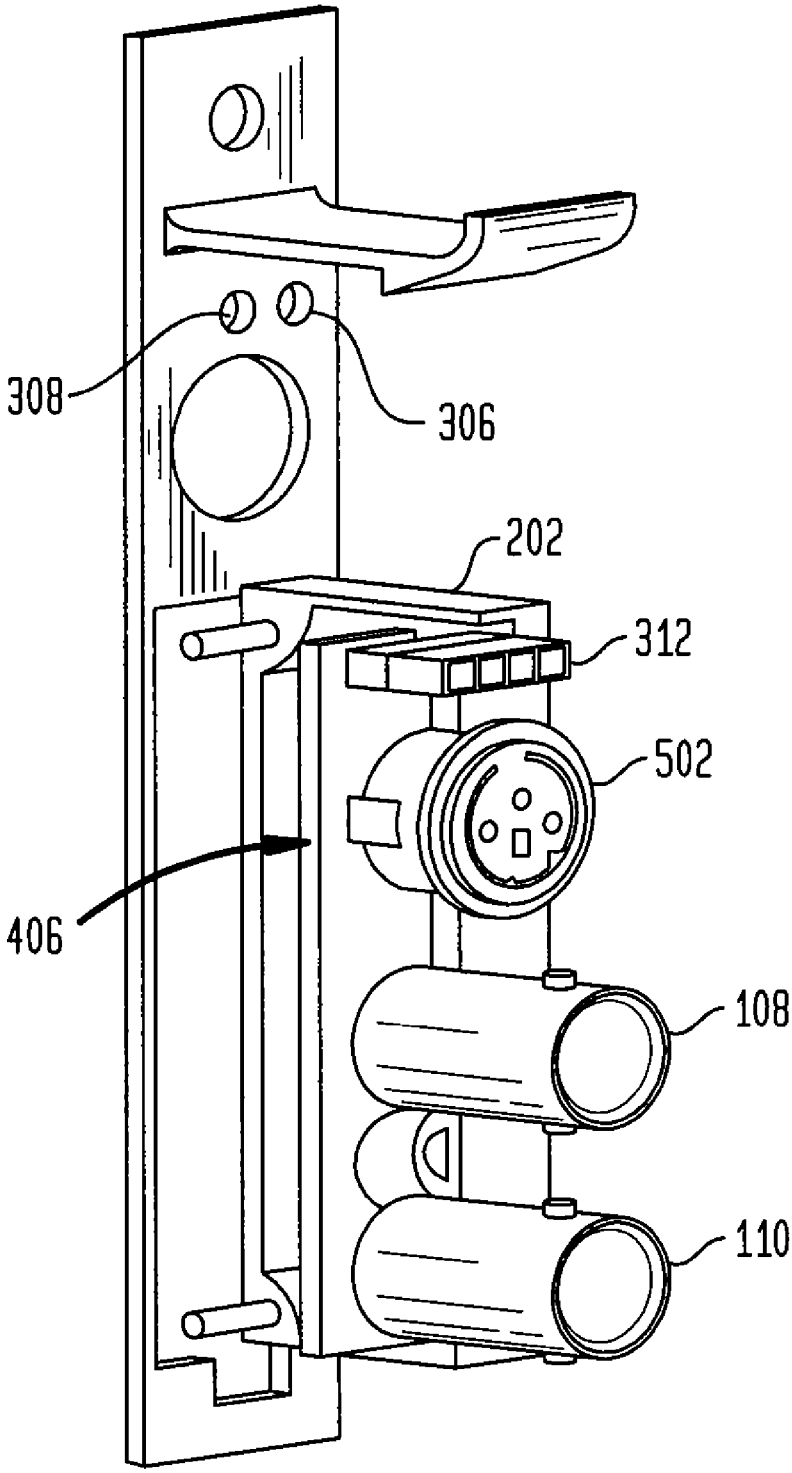
FIG. 5 is a perspective view (as seen from above and left from the perspective of the module) of the rear or back of an interconnection module with the monitoring module removed.
Figure 6:
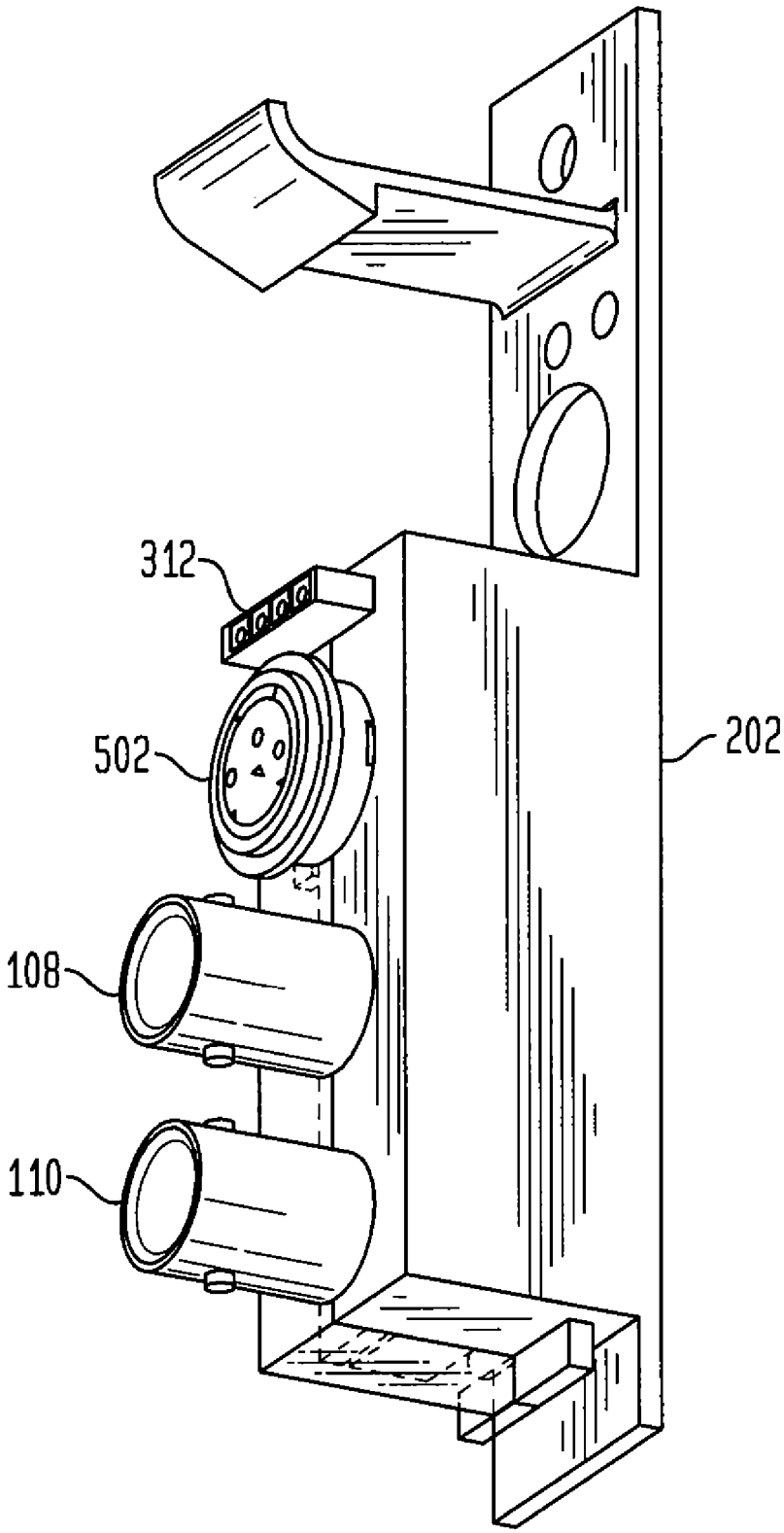
FIG. 6 is a perspective view (as seen from below and right from the perspective of the module) of the rear or back of an interconnection module with the monitoring module removed.

Interconnection module 106 is shown in two different perspective views in FIGS. 5 and 6. Note that these figures also show a power connector 502 mounted to PCB 406. Power connector 502 is a 3-pin DIN connector. As described in further detail below, DIN connector 502 is configured to receive power from an external source, and provide the power to monitor module 204 via PCB 406 and connector 312.

Figure 7:
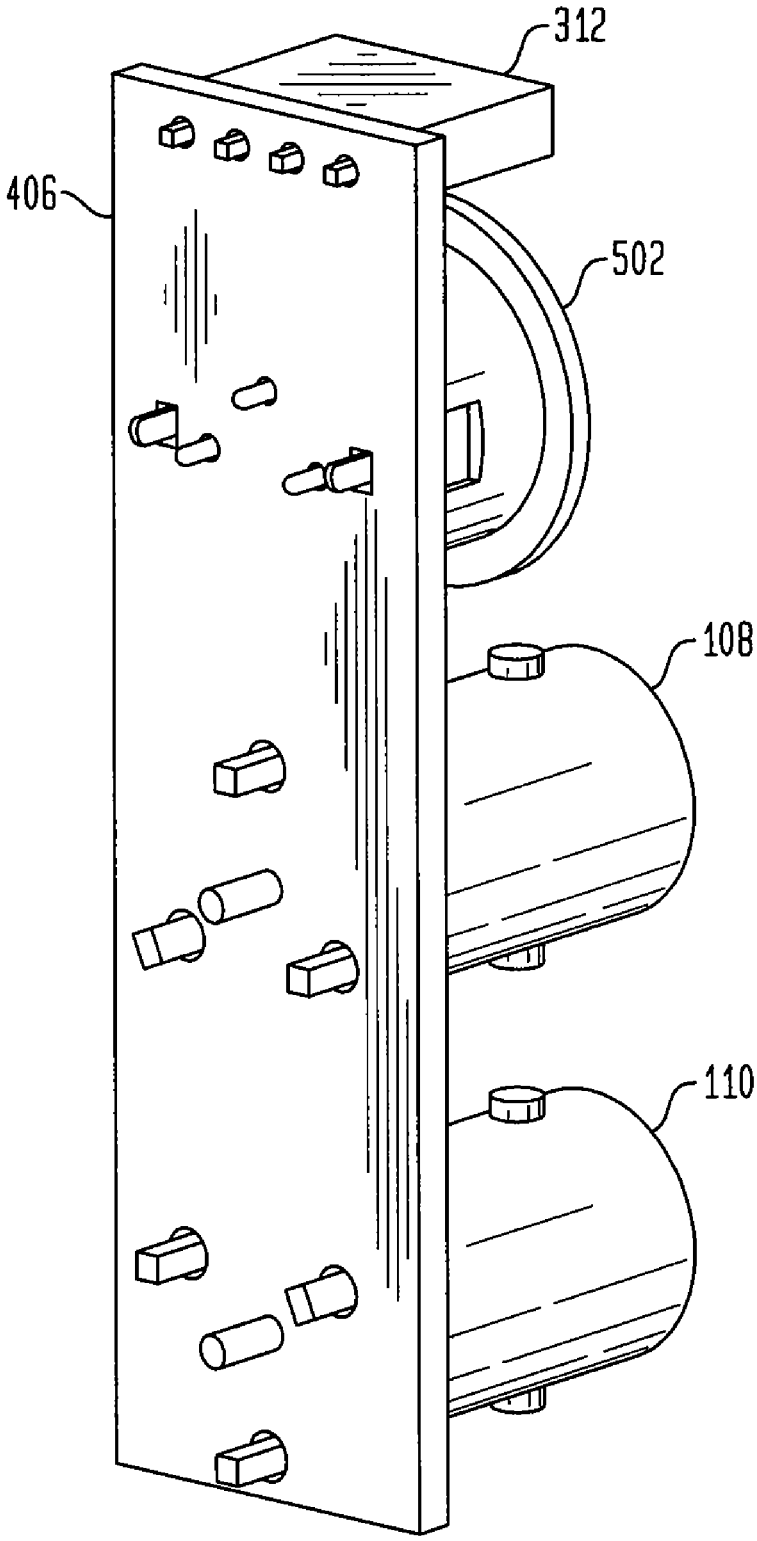
FIG. 7 is a perspective view (as seen from the front and left side from the perspective of the module) of a normal-through circuit board of the interconnection module.
Figure 8:
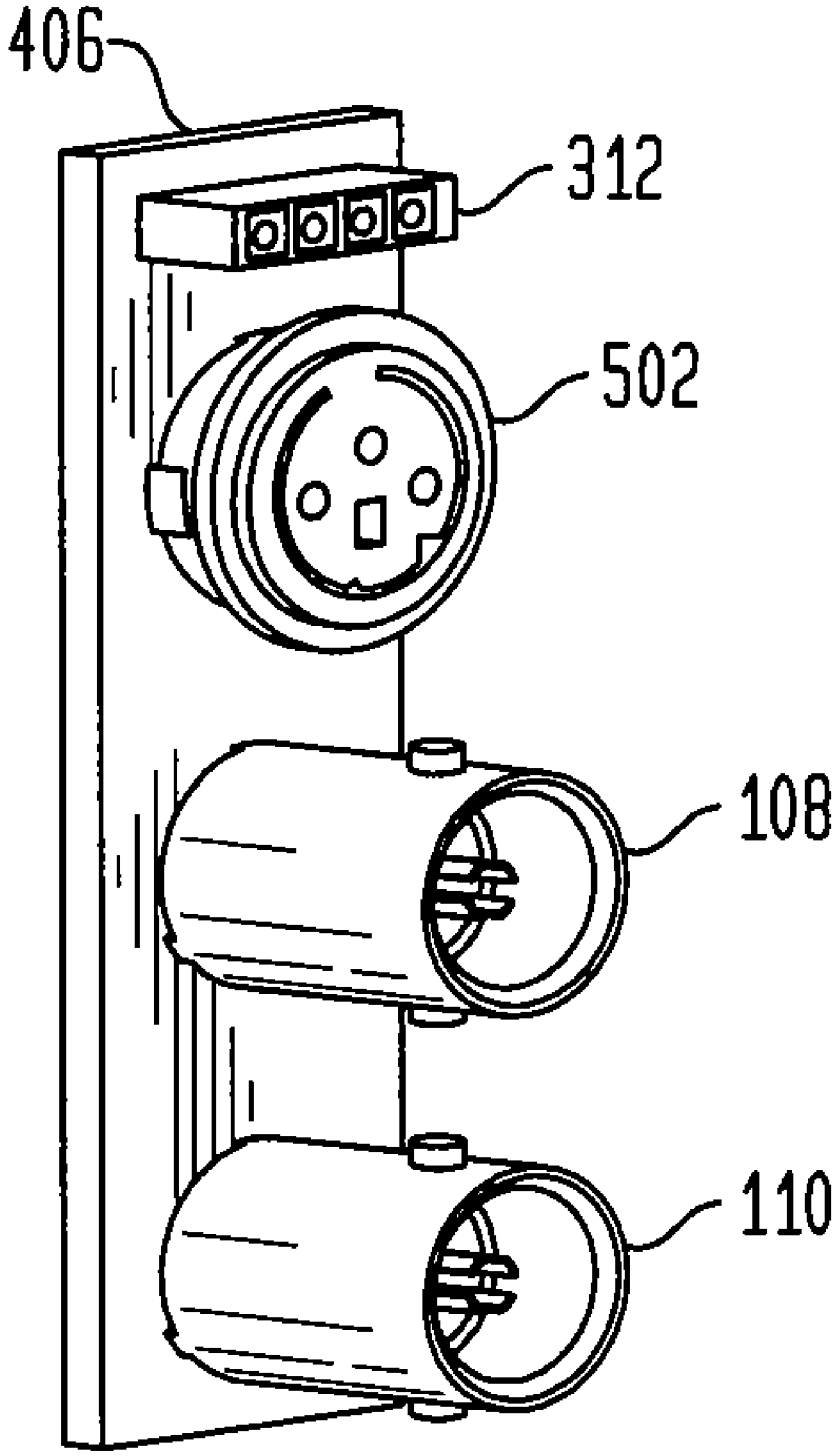
FIG. 8 is a perspective view (as seen from the rear and left side from the perspective of the module) of the normal-through circuit board of the interconnection module.
Figure 9:
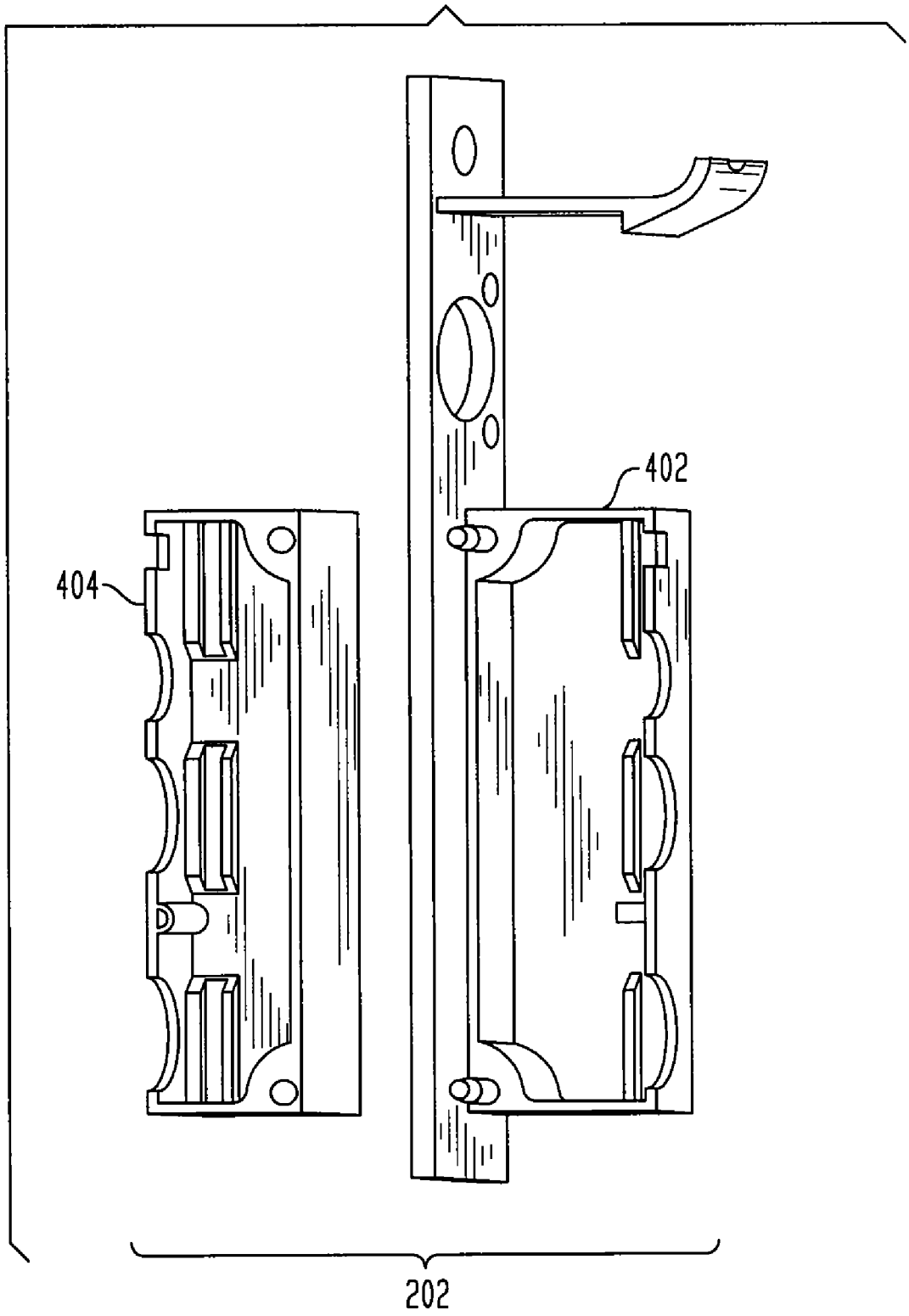
FIG. 9 is a perspective view showing the inner surfaces of the two housing halves of a housing of the interconnection module.

FIG. 7 is a perspective view of the back-side of PCB 406 showing electrical connector 312, power connector 502, and jacks 108, 110. FIG. 8 is a perspective view of a front-side of PCB 406. FIG. 9 shows housing halves 402, 404 of housing 202.

Figure 10:
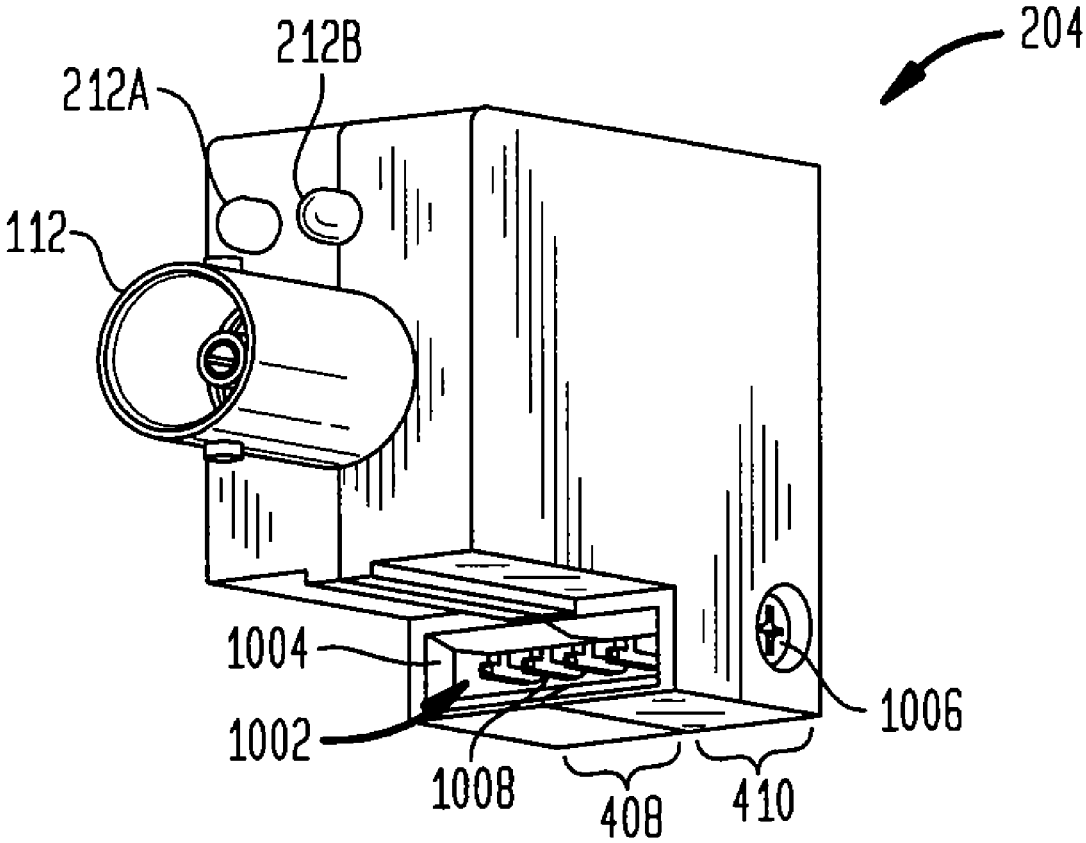
FIG. 10 is a perspective view (as seen from below and the left side from the perspective of the module) of the front of the monitor module of the interconnection module.

Monitor module 204 is shown in FIG. 10. Note that in the embodiment shown in FIG. 10, monitor module 204 includes LED 212A and LED 212B. LEDS 212 are configured in a side-by-side or horizontal arrangement. In this embodiment, LEDs 212A, 212B would correspond with openings 306, 308, respectively, of housing 202 as shown in FIGS. 5 and 6. To properly mate with the embodiment of housing 202 shown in FIGS. 2-4, LEDs 212A, 212B would be configured in a vertical alignment (not shown).

In the embodiment shown in FIG. 10, housing half 408 and housing half 410 are held together via a screw 1006. An opening in housing 204 forms an electrical connector 1002. Edges 1004 of the opening are chamfered to facilitate mating with electrical connector 312 of PCB 406 (see FIGS. 4-6). Contact pins 1008 of connector 1002 extend into the connector opening from PCB 412 (see FIG. 4).

Figure 11:
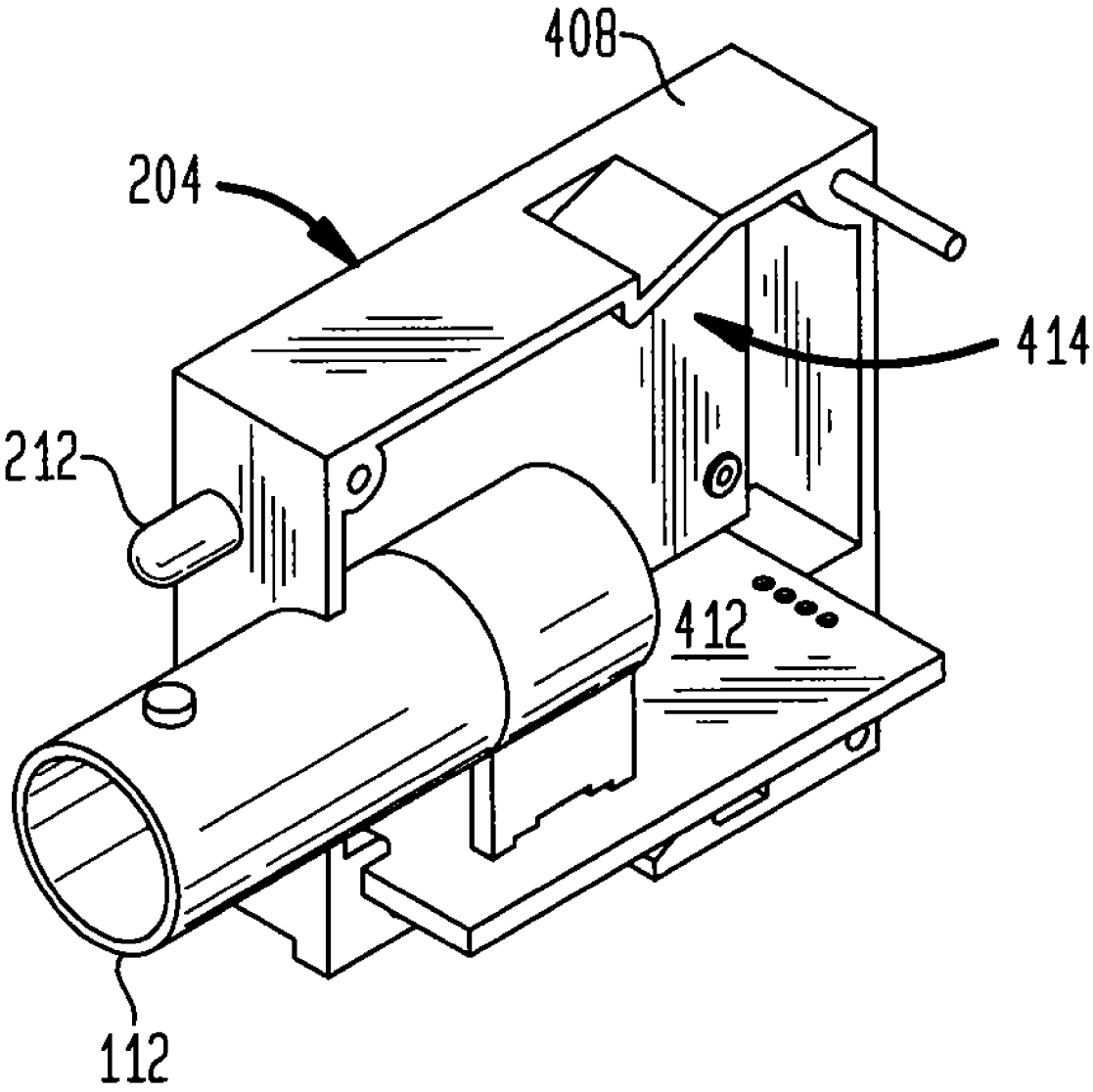
FIG. 11 is a perspective view (as seen from the above and the left side from the perspective of the module) of the front of the monitor module of the interconnection module with half of the housing removed to provide a view of the interior of the monitor module.

FIG. 11 is a perspective view of monitor module 204 with housing half 412 removed. As shown, PCB 414 is mounted in housing half 408 in a transverse manner, while PCB 414 is mounted in a vertical manner perpendicular to PCB 412. LEDs 212 are mounted on PCB 414.

Figure 12:
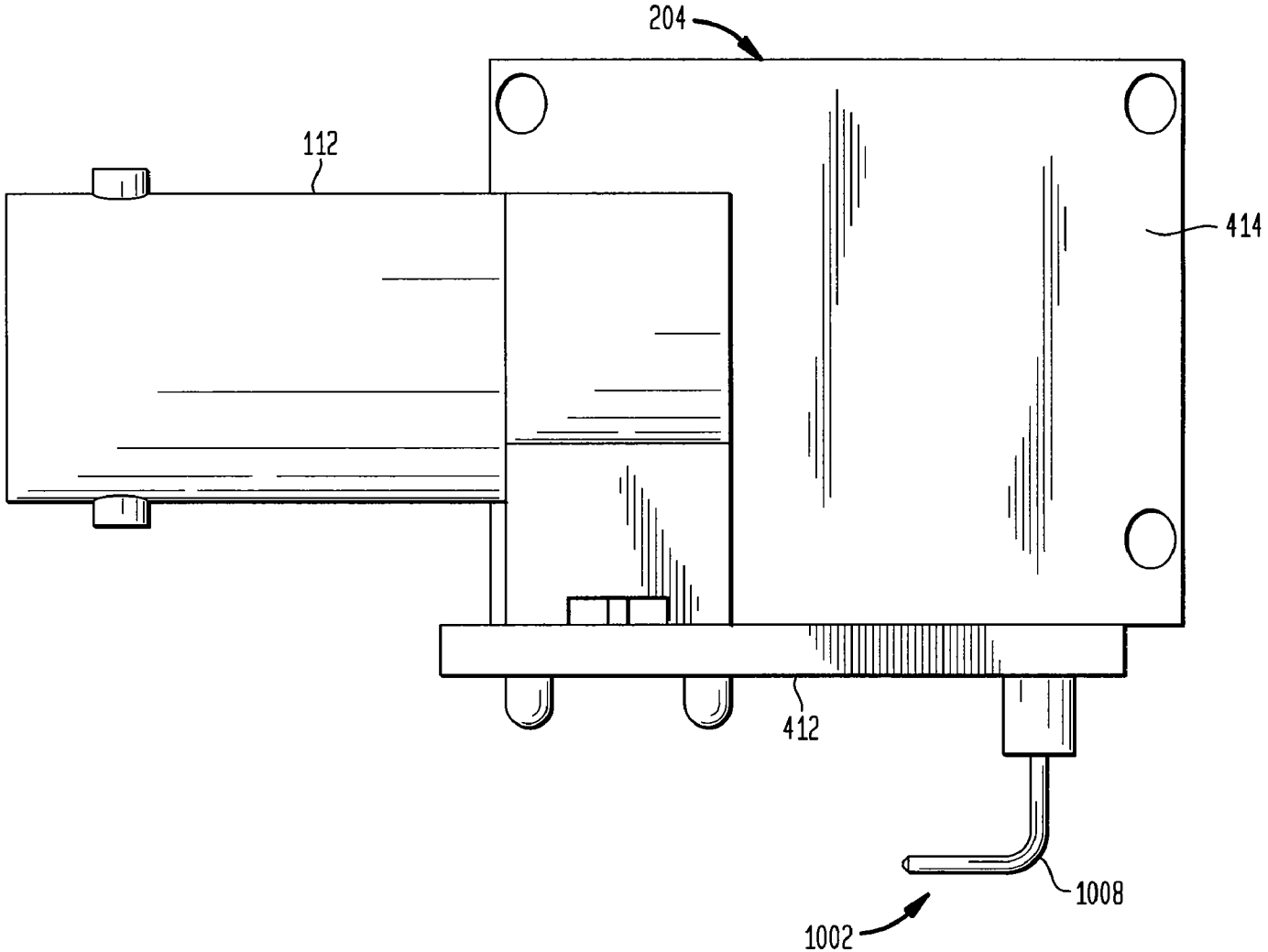
FIG. 12 is a side view of a portion of the monitor module of the interconnection module.

FIG. 12 is a side view of monitor module 204 showing the relationship of PCB 412 and PCB 414. Electrical contacts 1008 of connector 1002 are shown extending downward from PCB 412.

Figure 13:
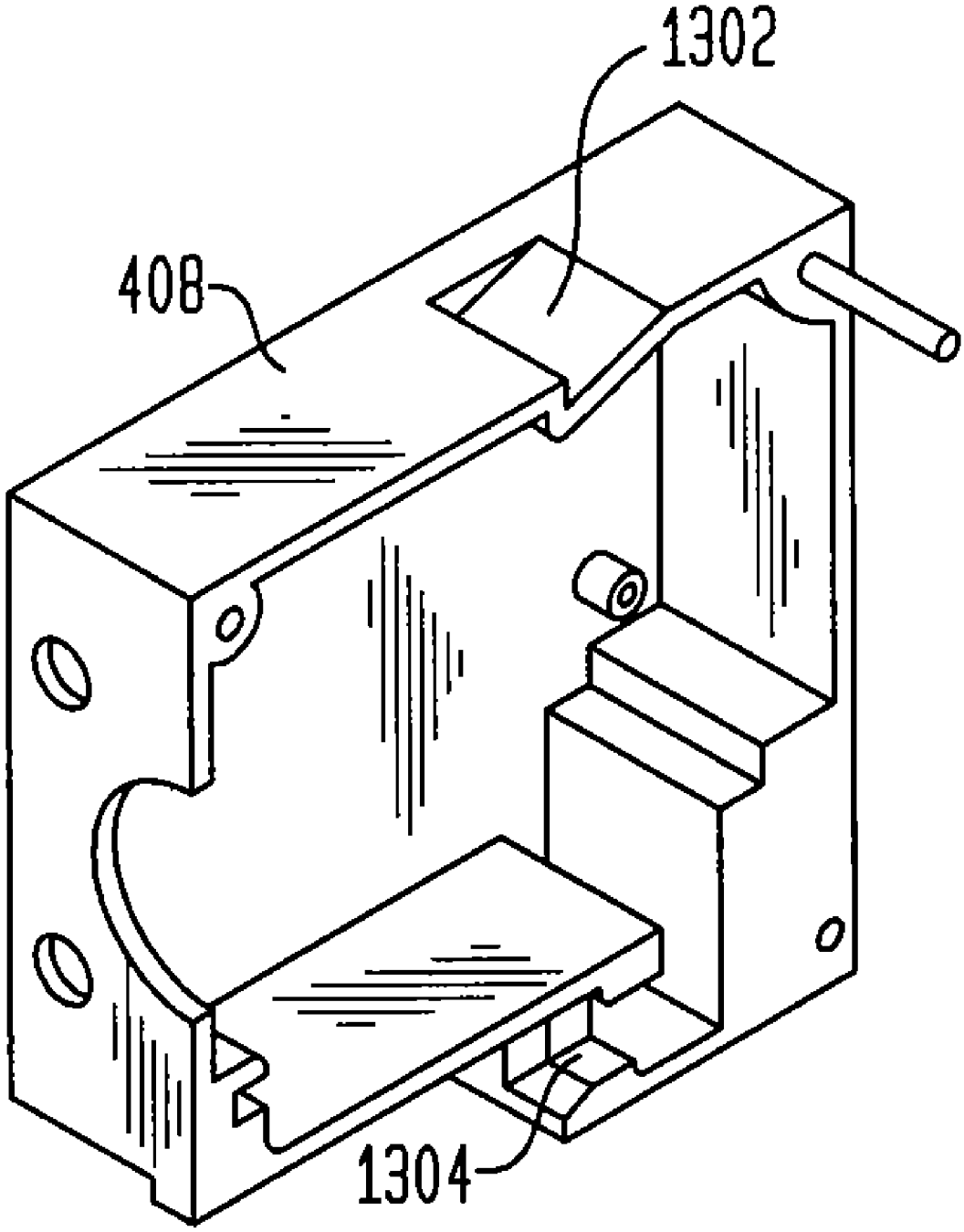
FIG. 13 is a perspective view showing the inner surface of one of two housing halves of the housing of the monitor module.
Figure 14:
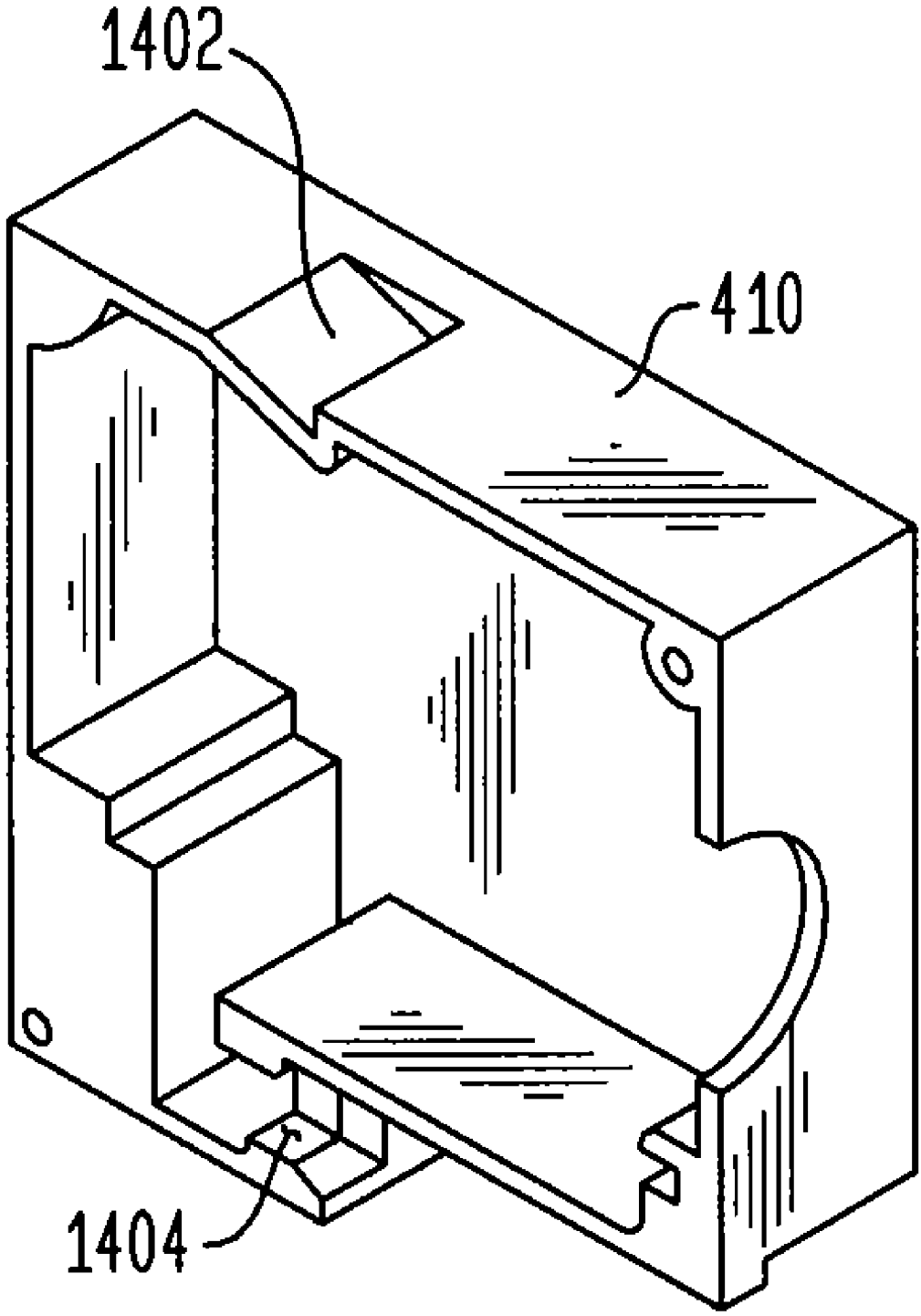
FIG. 14 is a perspective view showing the inner surface of the other of the housing halves of the housing of the monitor module.

FIG. 13 is a perspective view of housing half 408 showing the various features thereof. Similarly, FIG. 14 is a perspective view of housing half 410, showing the various features thereof. Note recessed portion 1302 of housing half 408, and recessed portion 1402 of housing half 410. When housing half 408 is mated with housing half 410, recessed portions 1302 and 1402 form a recess configured to mate with protrusion 310 of latch 208 of housing 202 (see FIGS. 2 and 3) to secure module 204 in housing 202.

Also as shown in FIGS. 13 and 14, portion 1304 of housing half 408, and portion 1404 of housing half 410 form an opening for connector 1002 when the two housing halves are mated. This opening, together with electrical contacts 1008 (see FIG. 12) form connector 1002 (see FIG. 10). The various other features of housing halves 408, 410 are configured for the secure mounting of PCBs 412 and 414 therein, as would be apparent to a person skilled in the art.

Figure 15:
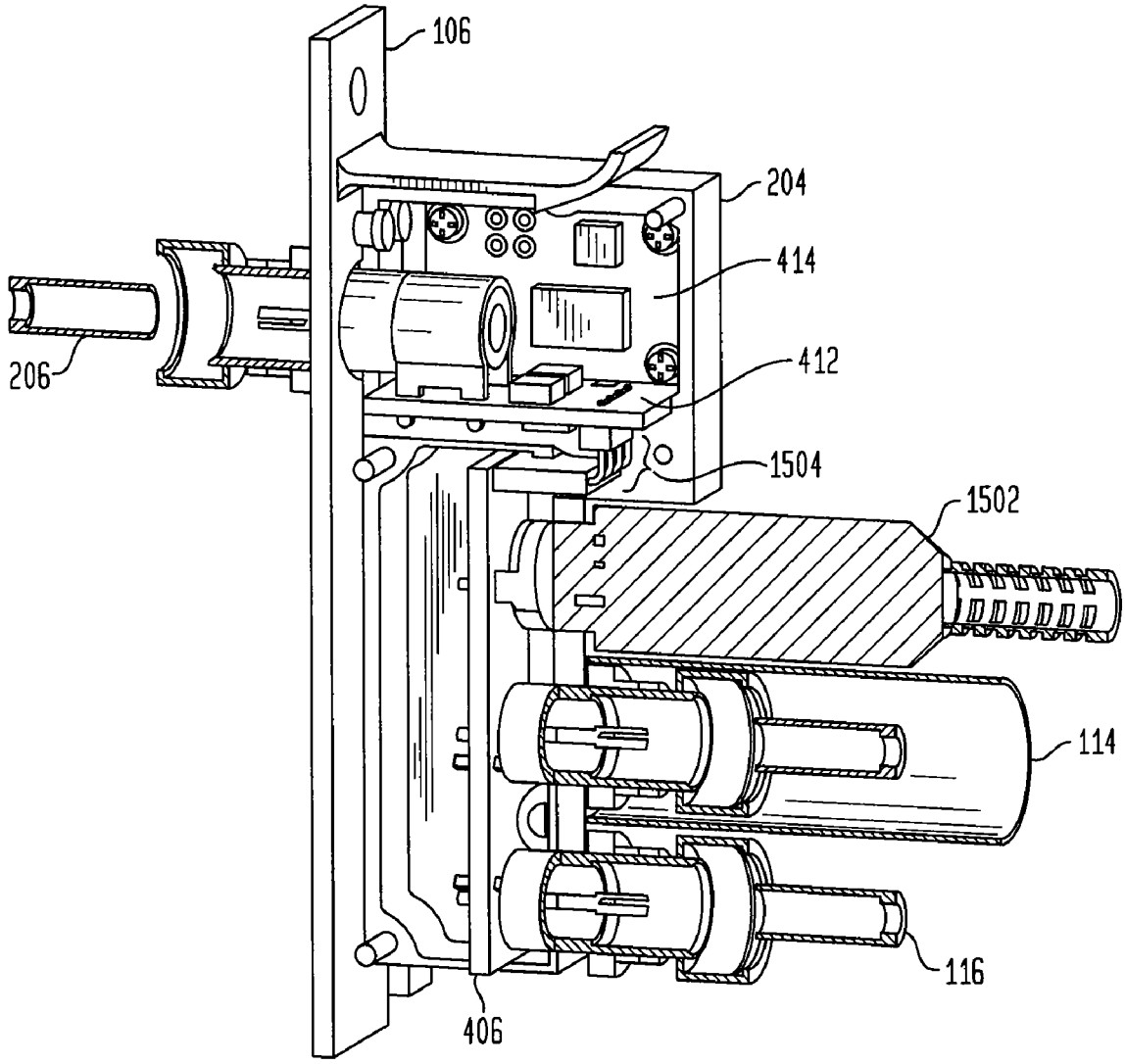
FIG. 15 is a perspective, cut-away view of an interconnection module connected to input, output, monitoring and power cables.

FIG. 15 is a partial cut-away view of interconnection module 106, connected to a power cable 1502, an input cable 114, an output cable 116, and a monitor cable 206. PCBs 406, 412 and 414 are shown. An interconnection 1504 between PCB 412 and PCB 406 is shown. Interconnection 1504 is formed by the interconnection of connector 312, with contacts 1008 of connector 1002. Power provided via power cable 1502 is routed to PCB 412 via interconnection 1504. The active circuitry (described below) on PCBs 412, 414 is powered by the power (e.g., 5 Volts) from power cable 1502. In the embodiment depicted in FIG. 15, there is no active circuitry on PCB 406. PCB 406 provides a normal-through connection between input cable 114, and input cable 116, provides a parallel connection from the normal-through connection to monitor module 204, and provides power from power cable 1502 to monitor module 204.

Figure 16A:
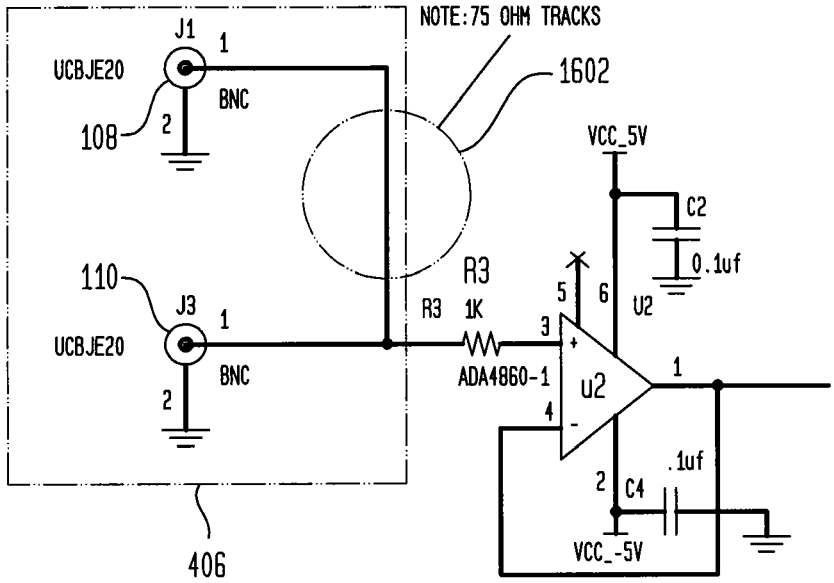
FIGS. 16A and 16B show an electrical schematic diagram of the interconnection module.
Figure 16A:
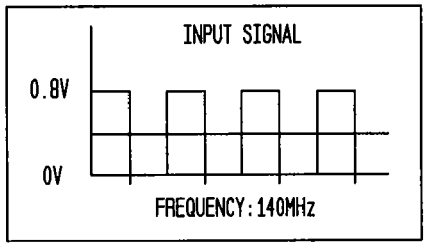
Figure 16A:
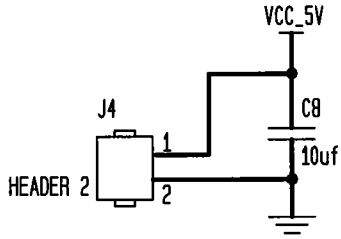
Figure 16A:
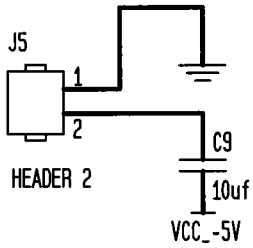
Figure 16B:
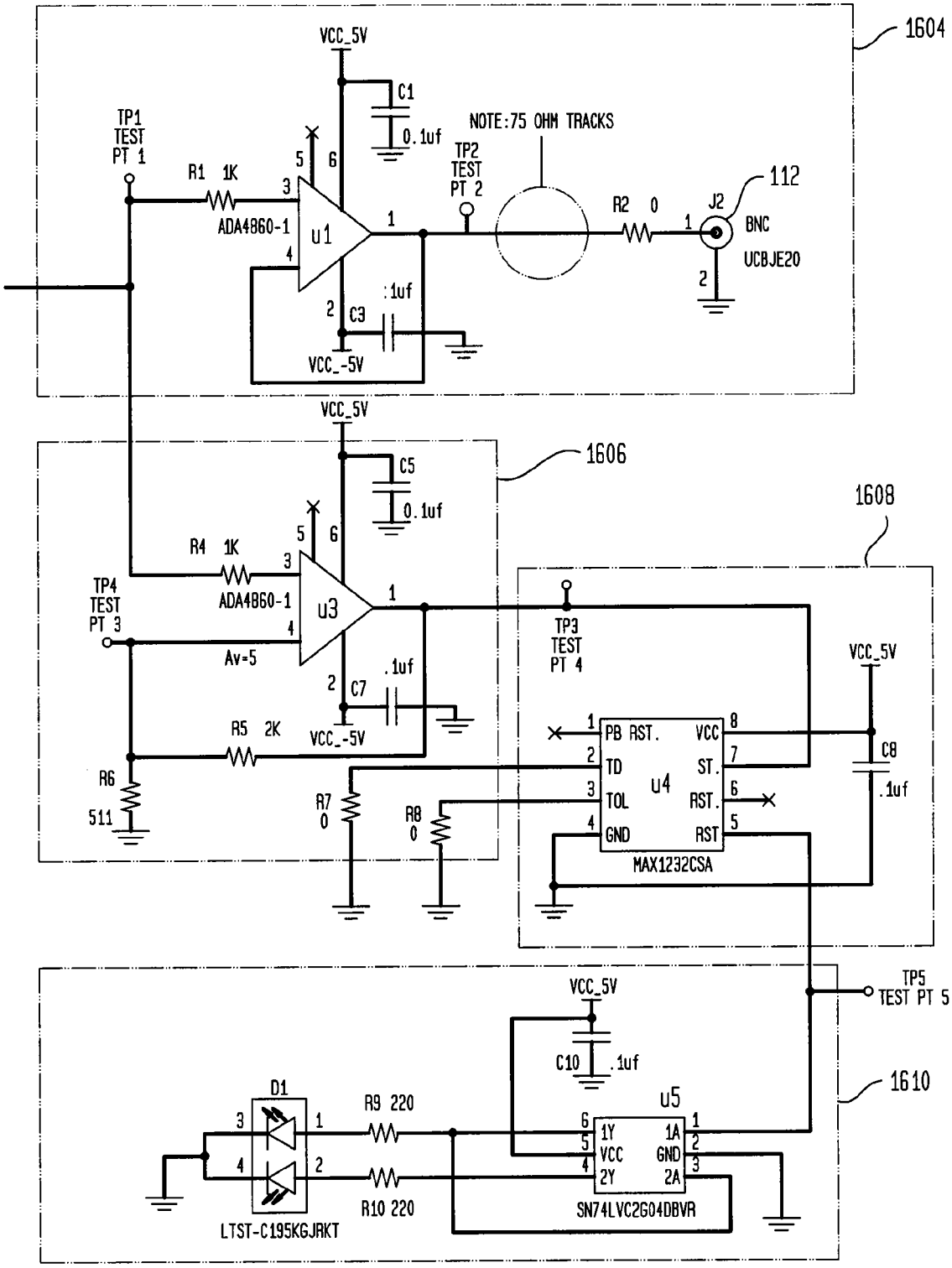

FIGS. 16A and 16B show an electrical schematic diagram of interconnection module 106. The embodiment of module 106 as shown in FIGS. 16A and 16B is particularly configured for use with SDI signals. In this example embodiment, the input signal would be a DVI signal having digital pulses of about 0.8 volts magnitude, and a frequency of about 135-140 MHz.

Printed circuit board 406 includes a conductive trace 1602 that provides the normal-through connection between input jack 108 and output jack 110. Input jack 108, output jack 110 and the conductive trace all exhibit 75 Ohms impendence at the frequency of interest. This provides for minimum signal attenuation with the input and output cables, which are 75 Ohm transmission lines.

Monitoring of the input signal (sometimes referred to herein as a "first signal") is done through a resistor R3, which is connected to the input of an operational amplifier U2. In one embodiment, R3 has a value of 1K Ohms. With this resistance, even if U2 were to fail such that its input were shorted to ground, the conductive trace 1602 would still see a minimum resistance of about 1K Ohms. This resistance is sufficiently large such that the monitoring circuit will not disturb the input signal.

Operational amplifier U2 buffers the input signal, and provides a very high impedance (e.g., 1M Ohm) to the input signal. The output of operational amplifier U2 is provided to a monitor circuit that includes operational amplifier U1. The output of U1 is provided to monitor jack 112. An operational amplifier U3 provides a buffered signal to microprocessor U4. Microprocessor U4 is, for example, a MAX1232 microprocessor monitor available from Maxim Integrated Products, Inc. of Sunnyvale, Calif. Microprocessor U4 drives two LEDs through a dual-inverter integrated circuit U5. In this example embodiment, the dual-inverter integrated circuit is a part number SN74LVC2G04DBVR available from Texas Instruments, Inc. of Dallas, Tex. Operational amplifiers U1, U2 and U3 are part number ADA4860-1 operational amplifiers, available from Analog Devices, Inc. of Norwood, Mass.

In this example embodiment, operational amplifier circuit U2, circuitry 1604 and circuitry 1606 are physically located on PCB 412. Circuitry 1608 and 1610 are physically located on PCB 414.

The two LEDs on PCB 414 provide the following functions. Referring to FIGS. 10 and 16, LED 212A is a red/green LED. LED 212A showing green indicates normal operation. LED 212A showing red indicates monitor port failure. LED 212B is a blue LED used to indicate power to the monitor module. LED 212B shows blue when power is applied to the monitor module and is unlit when power is not applied.

The present invention has been described in an example environment of SDI signals. The SDI signals being referenced are standard definition SDI (SDSDI). The invention could be used with other high frequency video signals such as high-definition television signals (HDTV) and high-definition video signals such as high definition SDI (HDSDI) signals. It will be apparent to a person skilled in the relevant arts, based on the disclosure set forth herein, how to apply the present invention to such other applications.

The present invention may further be used with optical input/output signals. In the case of optical signals, the input port of the interconnection module could have associated with it an optical-to-electrical converter and the output port of the interconnection module could have associated with it an electrical-to-optical converter, allowing the interconnection and monitoring to be done in the electrical domain. Alternatively, the interconnection may be made in the optical domain, and a tap from the straight-through optical connection could be used to feed an optical-to-electrical converter to produce a monitor signal for the monitor port. It will apparent to a person skilled in the relevant arts, based on the disclosure set forth herein, how to apply the present invention to such optical interconnection and monitoring.

While various embodiments of the present invention have been described above, it should be understood that they have been presented by way of example, and not limitation. It will be apparent to persons skilled in the relevant art(s) that various changes in form and detail can be made therein, without departing from the spirit and scope of the present invention. Thus, the present invention should not be limited by any of the exemplary embodiments described above, but should be defined only in accordance with the following claims and their equivalents.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting to the scope of the present invention in any way.

What is claimed is:

1. An interconnection module for providing a normal-through connection for a first signal, comprising:

a housing having a front face and a rear face;

an input connector at the rear face for receiving the first signal;

an output connector at the rear face for transmitting the first signal received at the input connector;

a conductor providing a signal path between the input connector and the output connector; and a monitor module mounted to the housing, the monitor module including a monitor port, and an active circuit for sensing the first signal and for providing to the monitor port a monitor signal indicative of the first signal, the active circuit being disposed in parallel to the signal path and exhibiting an impedance to the signal path sufficiently high so that the first signal is not disturbed by the active circuit.

2. The interconnection module of claim 1:

wherein the monitor module is removable from the housing and comprises a first electrical connector having a chamfered female opening; and wherein the housing comprises a second electrical connector for interfacing with the first electrical connector, the second electrical connector having a male extension configured to mate with the chamfered female opening, the chamfered female opening providing blind mate-ability between the first and second electrical connectors.

3. The interconnection module of claim 1:

wherein the housing comprises a first electrical connector having a chamfered female opening; and wherein the monitor module is removable from the housing and comprises a second electrical connector for interfacing with the first electrical connector, the second electrical connector having a male extension configured to mate with the chamfered female opening to provide blind mate-ability between the first and second electrical connectors.

4. The interconnection module of claim 1, wherein the monitor module is mounted to the housing so that the monitor port is disposed at the front face.

5. The interconnection module of claim 4, wherein the monitor module is removable from the housing.

6. The interconnection module of claim 5, wherein the monitor module is removable from the housing during transmission of the first signal through the signal path without disturbing the first signal.

7. The interconnection module of claim 6, wherein the active circuit comprises:

an operational amplifier circuit.

8. The interconnection module of claim 7, wherein the first connector, the second connector and the conductor exhibit an impedance of 75 Ohms.

9. The interconnection module of claim 8, wherein the impedance exhibited by the active circuit is not less than about 1000 Ohms.

10. An digital video module for providing a normal-through connection for a digital video signal, comprising:

a housing;

an input connector for receiving the digital video signal;

an output connector for transmitting the digital video signal received at the input connector;

a conductor providing a signal path between the input connector and the output connector; and a monitor module mounted to the housing, the monitor module including a monitor port, and an active circuit for providing to the monitor port a monitor signal indicative of the digital video signal, the active circuit being disposed in parallel to the signal path and exhibiting an impedance to the signal path sufficiently high so that the digital video signal is not disturbed by the active circuit.

11. The digital video module of claim 10:

wherein the monitor module is removable from the housing and comprises a first electrical connector having a chamfered female opening; and wherein the housing comprises a second electrical connector for interfacing with the first electrical connector, the second electrical connector having a male extension configured to mate with the chamfered female opening, the chamfered female opening providing blind mate-ability between the first and second electrical connectors.

12. The digital video module of claim 10:

wherein the housing comprises a first electrical connector having a chamfered female opening; and wherein the monitor module is removable from the housing and comprises a second electrical connector for interfacing with the first electrical connector, the second electrical connector having a male extension configured to mate with the chamfered female opening to provide blind mate-ability between the first and second electrical connectors.

13. The digital video module of claim 10, wherein the monitor module is removable from the housing.

14. The digital video module of claim 13, wherein the monitor module is removable from the housing during transmission of the digital video signal through the signal path without disturbing the digital video signal.

15. The digital video module of claim 10, wherein the active circuit comprises:

an operational amplifier circuit.

16. The digital video module of claim 15, wherein the first connector, the second connector and the conductor exhibit an impedance of about 75 Ohms at about 135 MHz.

17. The digital video module of claim 16, wherein the active circuit includes a series resistor having a resistance of at least about 1000 Ohms.

18. An interconnection module for providing a normal-through connection for a first signal, comprising:

a housing defining an input and an output;

a conductor disposed with the housing and providing to the first signal a signal path between the input and the output; and a monitor module mated to the housing, the monitor module including a monitor port, and an active circuit for sensing the first signal and for providing to the monitor port a monitor signal indicative of the first signal, the active circuit being disposed in parallel to the signal path and exhibiting an impedance to the signal path sufficiently high so that the first signal is not disturbed by the active circuit.

19. The interconnection module of claim 18, wherein the monitor module is removable from the housing.

20. The interconnection module of claim 19:

wherein removal or installation of the monitor module from the housing during transmission of the first signal through the signal path will not disturb the first signal;

wherein one of the monitor module and the housing comprises a first electrical connector having a chamfered female opening; and wherein the other one of the monitor module and the housing comprises a second electrical connector for interfacing with the first electrical connector, the second electrical connector having a male extension configured to mate with the chamfered female opening, the chamfered female opening providing blind mate-ability between the first and second electrical connectors.

* * * * *